US005802976A

United States Patent [19]

Friedrichs

[11] Patent Number: 5,802,976

[45] Date of Patent: Sep. 8, 1998

[54] DEVICE FOR CLEANING CYLINDER SURFACES IN PRINTING PRESSES

[75] Inventor: Jens Friedrichs, Heidelberg, Germany

[73] Assignee: Heidelberger Druckmaschien AG, Heidelberg, Germany

[21] Appl. No.: 784,402

[22] Filed: Jan. 17, 1997

[30] Foreign Application Priority Data

Jan. 17, 1996 [DE] Germany ..... 196 01 471.9

[51] Int. Cl.[6] ..... B41F 35/00

[52] U.S. Cl. ..... 101/424; 101/425; 399/352; 399/358

[58] Field of Search ..... 101/424, 425, 101/423, 183, DIG. 42; 15/256.5, 256.51, 256.52; 355/298, 300; 399/352, 349, 358; 118/70

[56] References Cited

U.S. PATENT DOCUMENTS

| | | | |
|---|---|---|---|
| 2,843,505 | 7/1958 | Riedel | 118/70 |
| 3,411,444 | 11/1968 | Boneschi | 101/425 |
| 3,465,715 | 9/1969 | Lynch et al. | 118/70 |
| 3,995,551 | 12/1976 | Mitter | 101/DIG. 42 |
| 4,571,962 | 2/1986 | Sando et al. | 118/70 |
| 4,915,989 | 4/1990 | Menser et al. | 118/70 |
| 4,928,622 | 5/1990 | Larsson et al. | 118/70 |
| 5,105,740 | 4/1992 | Loos et al. | 101/424 |
| 5,408,930 | 4/1995 | Loos | 101/423 |

FOREIGN PATENT DOCUMENTS

| | | |
|---|---|---|
| 1417322 | 10/1965 | France . |
| 1179223 | 6/1965 | Germany . |
| 1561029 | 7/1972 | Germany . |
| 2317174 | 10/1973 | Germany . |
| 4209642 | 9/1993 | Germany . |
| 0545362 | 5/1942 | United Kingdom . |
| 1390315 | 4/1975 | United Kingdom . |

*Primary Examiner*—Edgar S. Burr
*Assistant Examiner*—Anthony H. Nguyen
*Attorney, Agent, or Firm*—Nils H. Ljungman & Associates

[57] ABSTRACT

A device for cleaning cylinder surfaces in printing presses uses a cleaning cloth. The cleaning cloth extends over the length of the cylinder surface. The cleaning cloth is guided by an application element and is placed in contact with the cylinder surface to be cleaned by the application element. A drive mechanism moves the cleaning cloth through a washing device to remove the adhering dirt particles from the cleaning cloth.

18 Claims, 2 Drawing Sheets

DEVICE FOR CLEANING CYLINDER SURFACES IN PRINTING PRESSES

BACKGROUND OF THE INVENTION

1. Field of the Invention

This invention relates to a device for cleaning cylinder surfaces in printing presses, with a cleaning cloth which extends over the length of the cylinder surface, which cleaning cloth is guided by an application element or pressure element and is brought into contact with the cylinder surface to be cleaned by means of the application element, and with a drive mechanism to move the cleaning cloth.

2. Background Information

A similar known device, as disclosed in German Patent No. 42 09 642 A1 which corresponds to U.S. Pat. No. 5,408,930, is a cleaning device in which the cleaning cloth is fed from a clean cloth payoff roll by means of an application element to a used cloth take-up roll. When the supply of the cleaning cloth on the clean cloth payoff roll is used up, then both rolls must be replaced. For this purpose, the cleaning device must be removed from the machine, in a known manner. The replacement of the two rolls entails not only the costs for a new clean cloth payout roll, but also the costs for the disposal of the take-up roll which now contains the used cloth, which in some cases must be treated as hazardous or toxic waste.

OBJECT OF THE INVENTION

The object of the invention is to eliminate the disadvantages of known similar devices, and to simplify the cleaning of the cylinder surfaces.

SUMMARY OF THE INVENTION

The invention teaches that this object can be accomplished by realizing an endless cleaning cloth. Downstream of the application element, the endless cleaning cloth is guided through a washing device. As a result of this solution, the consumption of cleaning cloth is significantly reduced, and the useful life of a cleaning cloth can be extended by a factor of several times. Nor is it necessary to change the cloth rollers, which means that there are no large quantities of cleaning cloths to be disposed of. As a result of the washing device claimed by the invention, the particles of dirt and the ink residues are removed from the cleaning cloth, and can be filtered out of the washing agent, so that, for example, the only material requiring disposal is the dirt itself. Consequently, the invention makes possible a significant reduction in the costs entailed in the process of cleaning a cylinder surface.

One advantageous configuration of the invention is characterized by the fact that the washing device has wash tanks in which there are cleaning solutions such as washing agents, in which washing agents the cleaning cloth is immersed. The wash tanks can simply be removed and refilled with fresh cleaning solution or with filtered, reusable cleaning fluid. It is advantageous if one wash tank contains ink solvent and the second wash tank contains water, so that after the cleaning cloth leaves the washing device, a clean cleaning cloth is once again available.

The invention teaches that it is also advantageous that the cleaning cloth has a drive roller and a spring-assisted tensioning roller, and that the cleaning cloth is guided by additional deflector rollers. As a result of this arrangement, a constant tension on the cleaning cloth is maintained, and the tension on the cleaning cloth is equalized when the application mechanism is engaged, which means that it is possible to essentially guarantee the correct forward movement of the cleaning cloth during the cleaning processes. That is, when the application mechanism engages the cylinder to be cleaned, the cleaning cloth is brought close to the cylinder. The spring-assisted tensioning roller maintains an essentially constant tension in the cleaning cloth regardless of the position of the application mechanism. The spring-assisted tensioning roller prevents the tension in the cleaning cloth from increasing when the application mechanism engages the cleaning cloth with the cylinder. An increase in tension in the cleaning cloth can interfere with the proper cleaning of a cylinder and interfere with the drive mechanism of the cleaning cloth.

In an additional advantageous embodiment, corresponding to the cleaning cloth in the vicinity of the washing device there are mechanical and/or pneumatic dirt-removal elements, whereby it can be advantageous to realize the dirt-removal elements in the form of brushes, blowers, or blast nozzles. The brushes can be used to reliably remove any dirt which adheres to the cleaning cloth, whereby blowers can blow air through the cloth, so that dirt can also be removed from the fabric of the cloth. The blowers can be used, for example, to blow either cleaning agent or air through the cloth.

If the cleaning device is removed from the printing press, it is advantageous if the cleaning cloth and the wash tanks can be replaced along with the cleaning device. In one application, the cleaning cloth and the wash tanks in the cleaning device can be replaced when the cleaning device has been removed from the printing press, so that the cleaning device is then ready to be replaced into the printing press. Alternatively, the entire cleaning device, including the cleaning cloth and wash tanks, can be replaced by the operator as a single unit, thereby reducing the time required for the operator to replace the cleaning cloth. If the entire cleaning device is exchanged as a single unit by the operator, then the cleaning cloth and tanks in the cleaning device could be exchanged at some other time.

To reduce solvent vapors in the printing press, the wash tanks are realized in the form of closed containers, and have slots for the passage of the cleaning cloth. The invention teaches that this cleaning process is assisted by the fact that, downstream of the cleaning cloth washing device, there are wringer rollers which completely remove any washing agent residue from the cloth.

If the system is designed so that it is necessary to remove the cleaning device from the printing press only when it is necessary to replace the cleaning cloth, which replacement is necessary only after a rather long period of time, the invention teaches in an additional embodiment that the wash tanks are connected to a cleaning circuit for the washing agent, which connection can be created, for example, by means of a simple hose coupling. It is thereby possible, e.g. after a specified number of washing processes, to filter the washing agent currently being used and return it to the wash tanks. This process can be conducted fully automatically, so that no additional work is required on the part of the operator, which would increase the costs of operation of the printing press.

One feature of the invention resides broadly in an apparatus for cleaning a cylinder surface in a printing press, the apparatus comprising: an application element to dispose an endless cleaning cloth in contact with a cylinder surface; a device to wash a dirty endless cleaning cloth; an arrangement to direct an endless cleaning cloth through the device to wash a dirty endless cleaning cloth; and a drive mechanism to drive an endless cleaning cloth through the apparatus for cleaning a cylinder surface in a printing press, and thus, through the washing device and across the application element.

Another feature of the invention resides broadly in an apparatus for cleaning a cylinder surface in a printing press, the apparatus comprising: a housing unit; the housing unit comprising: an arrangement for permitting the housing unit to be disposed in a printing press; an application element to dispose a cleaning cloth in contact with a cylinder surface; a device to wash a dirty cleaning cloth; an arrangement to direct a cleaning cloth through the device to wash a dirty cleaning cloth; and a drive mechanism to drive a cleaning cloth through the apparatus for cleaning a cylinder surface in a printing press, and thus, through the washing device and by the application element.

BRIEF DESCRIPTION OF THE DRAWINGS

The present invention is illustrated in the accompanying drawings, in which.

DESCRIPTION OF THE PREFERRED EMBODIMENT

Figure 1:
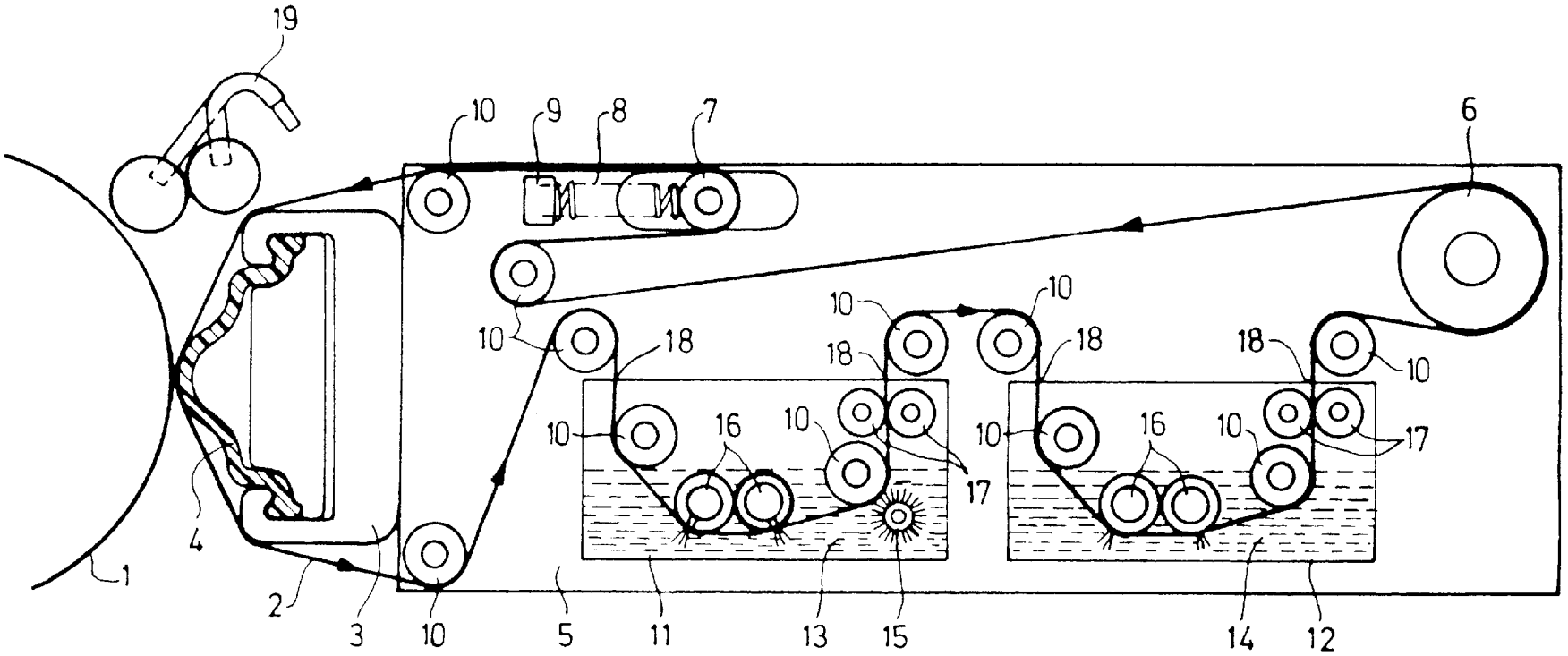
FIG. 1 is a schematic representation of the apparatus to clean a cylinder surface, which shows a side view of the cleaning apparatus.

In FIG. 1, the device to clean a cylinder surface 1 has an endless cleaning cloth 2 which is guided by means of an application element 3. In the illustrated embodiment, the application element 3 is realized with an air-assisted membrane 4, by means of which the cleaning cloth 2 can be pressed against the cylinder surface 1. The application element 3 can also be mounted so that it can pivot in side pieces 5 of the cleaning device, e.g. so that it can be used to clean two cylinder surfaces. The side pieces 5 can thereby be mounted in the side frames of the press, and the side pieces 5 can be removed from the printing press by means of guides (not shown), for example if the cleaning cloth 2 of the cleaning device is to be replaced outside the printing press.

As shown in FIG. 1, the invention teaches that the cleaning cloth 2 is realized so that it is endless, and for forward movement the cleaning cloth 2 is driven by a drive roller 6. The cleaning cloth 2 is also guided by a tensioning roller 7, which tensioning roller 7 is assisted by means of compression springs 8, which compression springs 8 are supported on a bearing part 9, which bearing part 9 is in turn fastened to the side pieces 5. This arrangement essentially guarantees that the cleaning cloth 2 is always held under constant tension. Inside the cleaning device, the cleaning cloth 2 is guided by additional deflector rollers 10.

As shown in FIG. 1, the washing device consists of two wash tanks 11, 12, whereby, for example, the wash tank 11 can contain an ink solvent 13 and the second wash tank 12 can contain water 14. In the wash tank 11, corresponding to the cleaning cloth 2, there can also be a brush roller 15 which removes particles of dirt from the surface of the cleaning cloth 2. There can also be blowers 16, through which either air or a washing fluid can be blown, for example to blow through the cloth and thereby remove any adhering dirt particles. After every washing process, it is advantageous if the cleaning cloth 2 is guided between wringer rollers 17, so that excess cleaning agent is removed.

In this case it is advantageous if the wash tanks 11, 12 are almost completely closed, and only have slots 18 for the passage of the cleaning cloth 2. To make possible the easy replacement of the cleaning cloth 2, the wash tanks 11, 12 can be closed with lids.

In a known manner, the cleaning cloth 2 can also be wetted externally with water or detergent or cleaning agent before the cleaning of the cylinder surface 1.

With a wetting device 19, an agent for cleaning the cylinder 1 can be applied to the cleaned cleaning cloth 2 before the cleaning cloth 2 is brought into contact with the cylinder 1.

In the illustrated embodiment, the drive roller 6 is controlled so that, after the washing of a cylinder surface 1, the wash cloth 2 is guided through the two wash tanks 11, 12, so that no dirt particles can dry on the cleaning cloth.

Figure 2:
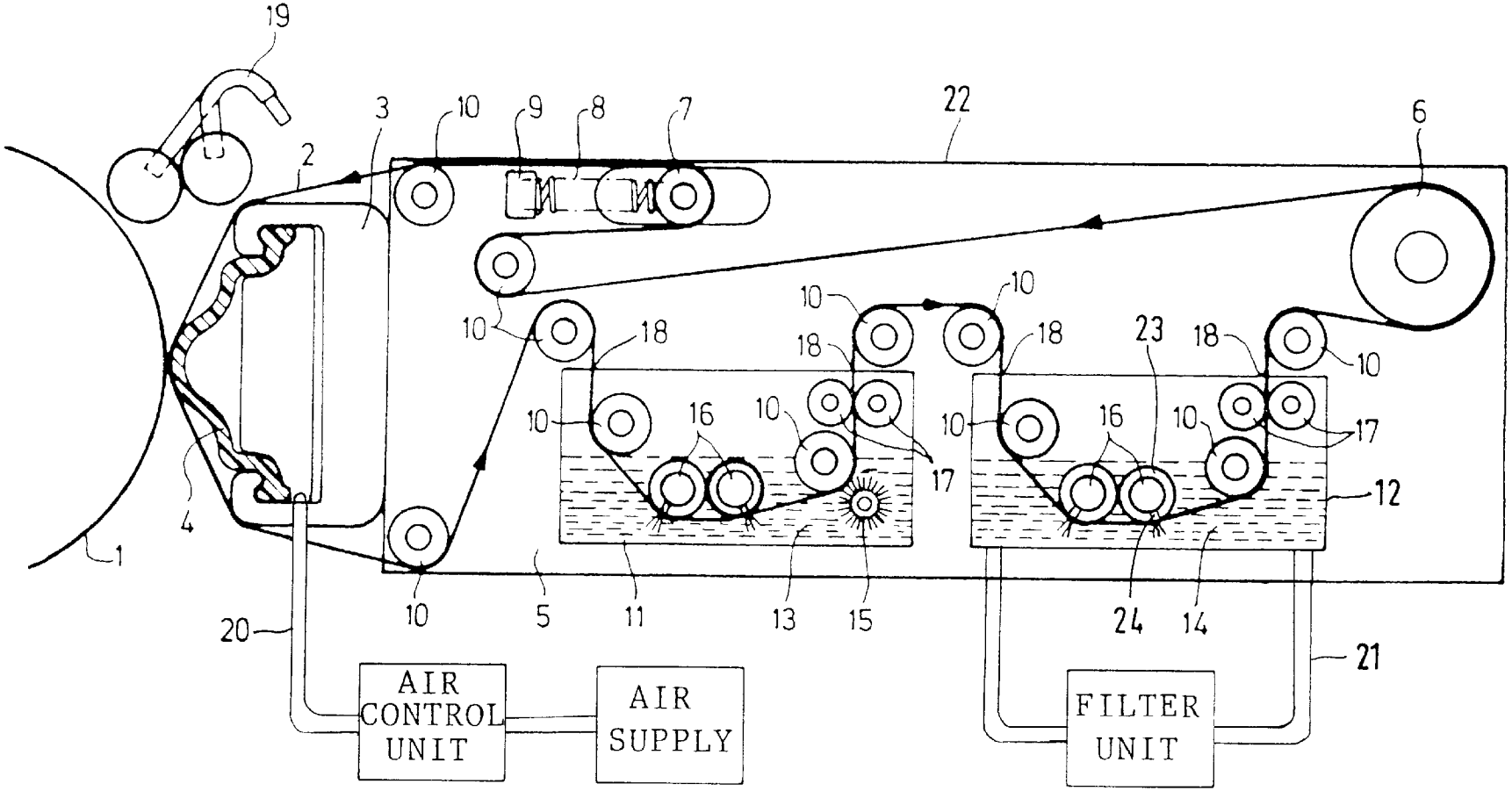
FIG. 2 is similar to FIG. 1 but shows additional peripheral features.

FIG. 2 shows essentially the same device to clean a cylinder surface 1 but with more details. The air-assisted membrane 4 of the application means is connected to an air line 20. The air line 20 is connected to an air control unit, which air control unit regulates the amount of air flow in the air-assisted membrane 4. The air control unit regulates air flow to the air-assisted membrane from an air supply, for engaging the wash cloth 2 with the cylinder surface 1. In addition, the air control unit regulates the flow of air away from the air-assisted membrane, for disengaging the wash cloth 2 from the cylinder surface 1.

FIG. 2 shows blowers 16 being constructed of tubes 23. The tubes 23 have slots or holes 24. Air or washing fluid can be fed into the central portion and then ejected through the slots or holes 24. The cleaning cloth 2 is drawn across the slots or holes 24 of the blowers 16, so that the air or cleaning fluid is forced through the cleaning cloth 2 to remove dirt from the cleaning cloth 2. The slots or holes 24 can be a single long slot the width of the cleaning cloth 2 or can be a series of slots which series of slots can be staggered. The slots or holes 24 can be a single line of holes, the line of holes extending the width of the cleaning cloth, or can be a series of lines of holes with the holes staggered from one line of holes to the next line of holes. In addition, the slots or holes can be a combination of slots and holes.

FIG. 2 also shows a cleaning circuit 21 which has a filter unit for cleaning the washing agent 14, which washing agent 14 is water in the wash tank 12. The washing agent 14 can be withdrawn from the wash tank 12, circulated through the cleaning circuit 21, and returned to the wash tank 12 after the washing agent 14 has been cleaned by the filter unit. In an alternate embodiment, the filtered cleaning agent 14 could be returned to the blowers 16 directly, thereby using the cleaning circuit 21 to also provide filtered cleaning agent to the blowers 16 directly.

The side pieces 5 make up at least part of a housing or support body 22 of the device to clean a cylinder, which housing or support body 22 supports essentially all of the components of the device to clean a cylinder. The side pieces 5 can have connecting members which connect the two side pieces 5 to one another, thus, resulting in an essentially open support body 22. Alternatively, the support body 22 can be a housing or cassette for essentially completely enclosing all of the components, with the side pieces 5 forming sides of the housing or cassette.

One feature of the invention resides broadly in the device for cleaning cylinder surfaces in printing presses, with a cleaning cloth which extends over the length of the cylinder surface, which cleaning cloth is guided by an application element and by means of the application element is placed in contact with the cylinder surface to be cleaned, and with a drive mechanism to move the cleaning cloth, characterized by the fact that the cleaning cloth 2 is realized so that it is endless, and downstream of the application element 3 the cleaning cloth 2 is guided through a washing device.

Another feature of the invention resides broadly in the device characterized by the fact that the washing device has wash tanks 11, 12 in which there are washing agents 13, 14, and in which the cleaning cloth 2 is immersed.

Yet another feature of the invention resides broadly in the device characterized by the fact that one wash tank 11 contains ink solvent 13 and a second wash tank 12 contains water 14.

Still another feature of the invention resides broadly in the device characterized by the fact that corresponding to the cleaning cloth 2 are a drive roller 6 and a spring-assisted tensioning roller 7, and that the cleaning cloth 2 is guided by additional deflector rollers 10.

A further feature of the invention resides broadly in the device characterized by the fact that corresponding to the cleaning cloth 2, in the vicinity of the washing device 11, 12 there are mechanical and/or pneumatic elements to remove the dirt.

Another feature of the invention resides broadly in the device characterized by the fact that the dirt-removing elements are realized in the form of brushes 15 and/or blowers 16.

Yet another feature of the invention resides broadly in the device characterized by the fact that the cleaning cloth 2 and the wash tanks 11, 12 can be replaced along with the cleaning device.

Still another feature of the invention resides broadly in the device characterized by the fact that the wash tanks 11, 12 are closed, and have slots 18 for the passage of the cleaning cloth 2.

A further feature of the invention resides broadly in the device characterized by the fact that downstream of the wash tanks 11, 12, there are wringer rollers 17 for the cleaning cloth 2.

Another feature of the invention resides broadly in the device characterized by the fact that the wash tanks 11, 12 are connected to a cleaning circuit for the washing agent.

The components disclosed in the various publications, disclosed or incorporated by reference herein, may be used in the embodiments of the present invention, as well as, equivalents thereof.

All, or substantially all, of the components and methods of the various embodiments may be used with at least one embodiment or all of the embodiments, if more than one embodiment is described herein.

All of the patents, patent applications and publications recited herein are hereby incorporated by reference as if set forth in their entirety herein.

The corresponding foreign patent publication applications, namely, Federal Republic of Germany Patent Application No. 196 01 471.9, filed on Jan. 17, 1996, having inventor Jens Friedrichs, and DE-OS 196 01 471.9 and DE-PS 196 01 471.9.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

NOMENCLATURE

1 Cylinder surface
2 Cleaning cloth
3 Application element
4 Membrane
5 Side part
6 Drive roller
7 Tensioning roller
8 Compression spring
9 Bearing part
10 Deflector roller
11 Wash tank
12 Wash tank
13 Ink solvent
14 Water
15 Brush roller
16 Blower
17 Wringer roller
18 Passage slot
19 Nozzles
20 Air line
21 Cleaning circuit
22 Support body or Housing
23 Tubes
24 Slots

What is claimed is:

1. An apparatus for cleaning a cylinder surface in a printing press, said apparatus comprising:

an application element to dispose an endless cleaning cloth in contact with a cylinder surface;

a device to wash a dirty endless cleaning cloth;

an arrangement to direct an endless cleaning cloth through said device to wash a dirty endless cleaning cloth;

a cleaning cloth drive mechanism, said cleaning cloth drive mechanism comprising an arrangement configured and disposed to move an endless cleaning cloth across said application element and through said arrangement to direct an endless cleaning cloth through said washing device;

said device to wash a dirty endless cleaning cloth comprising a first wash tank to immerse a dirty endless cleaning cloth in an ink solvent; and said device to wash a dirty endless cleaning cloth comprising a second wash tank to immerse a dirty endless cleaning cloth in water.

2. The apparatus for cleaning a cylinder surface of claim 1, wherein said device to wash a dirty endless cleaning cloth comprises wringer rollers disposed to wring cleaning agent from an endless cleaning cloth upon the endless cleaning cloth being immersed in the washing agent.

3. The apparatus for cleaning a cylinder surface of claim 1, wherein at least one of said first wash tank and said second wash tank comprises structure to permit connection to a device to clean washing agent disposed in said at least one of said first wash tank and said second wash tank.

4. The apparatus for cleaning a cylinder surface of claim 1, wherein:

said arrangement to direct an endless cleaning cloth through said device to wash a dirty endless cleaning cloth comprises a plurality of deflector rollers to direct an endless cleaning cloth;

said cleaning cloth drive mechanism comprises a drive roller to drive an endless cleaning cloth; and said apparatus for cleaning a cylinder surface comprises a spring-assisted tensioning roller to maintain substantially constant tension in an endless cleaning cloth.

5. The apparatus for cleaning a cylinder surface of claim 1, wherein:

said device to wash a dirty endless cleaning cloth comprises at least one of:

a mechanical arrangement to remove dirt from an endless cleaning cloth; and an arrangement to form a flow of fluid to remove dirt from an endless cleaning cloth.

6. The apparatus for cleaning a cylinder surface of claim 5, wherein:

said mechanical arrangement to remove dirt comprises a brush to brush dirt off an endless cleaning cloth; and said arrangement to form a flow of fluid comprises a blower to blow a fluid through an endless cleaning cloth.

7. The apparatus for cleaning a cylinder surface of claim 1, wherein said apparatus for cleaning a cylinder surface is configured as a single replaceable unit comprising said first and second wash tanks and an endless cleaning cloth, to permit removal and replacement of said apparatus from a printing press.

8. The apparatus for cleaning a cylinder surface of claim 1, wherein:

at least one of said first wash tank and said second wash tank comprises a substantially completely enclosed wash tank to enclose a washing agent; and said substantially completely enclosed wash tank comprises at least one slot to permit passage of an endless cleaning cloth in and out of said substantially completely enclosed wash tank.

9. An apparatus for cleaning a cylinder surface in a printing press, said apparatus comprising:

a housing unit;

said housing unit comprising:

an arrangement for permitting said housing unit to be disposed in a printing press;

an application element to dispose an endless cleaning cloth in contact with a cylinder surface;

a device to wash a dirty endless cleaning cloth;

an arrangement to direct an endless cleaning cloth through said device to wash a dirty endless cleaning cloth; and a cleaning cloth drive mechanism, said cleaning cloth drive mechanism comprising an arrangement configured and disposed to move an endless cleaning cloth across said application element and through said arrangement to direct an endless cleaning cloth through said washing device;

said device to wash a dirty endless cleaning cloth comprising a first wash tank to immerse a dirty endless cleaning cloth in an ink solvent; and said device to wash a dirty endless cleaning cloth comprising a second wash tank to immerse a dirty endless cleaning cloth in water.

10. The apparatus for cleaning a cylinder surface of claim 9, wherein:

said arrangement to direct an endless cleaning cloth through said device to wash a dirty endless cleaning cloth comprises a plurality of deflector rollers to direct an endless cleaning cloth;

said cleaning cloth drive mechanism comprises a drive roller to drive an endless cleaning cloth; and said apparatus for cleaning a cylinder surface comprises a spring-assisted tensioning roller to maintain substantially constant tension in an endless cleaning cloth.

11. The apparatus for cleaning a cylinder surface of claim 10, wherein:

said device to wash a dirty endless cleaning cloth comprises at least one of:

a mechanical arrangement to remove dirt from an endless cleaning cloth; and an arrangement to form a flow of fluid to remove dirt from an endless cleaning cloth.

12. The apparatus for cleaning a cylinder surface of claim 11, wherein:

said mechanical arrangement to remove dirt comprises a brush to brush dirt off an endless cleaning cloth; and said arrangement to form a flow of fluid comprises a blower to blow a fluid through an endless cleaning cloth.

13. The apparatus for cleaning a cylinder surface of claim 12, wherein:

at least one of said first wash tank and said second wash tank comprises a substantially completely enclosed wash tank to enclose a corresponding washing agent; and said substantially completely enclosed wash tank comprises at least one slot to permit passage of an endless cleaning cloth in and out of said substantially completely enclosed wash tank.

14. The apparatus for cleaning a cylinder surface of claim 13, wherein said device to wash a dirty endless cleaning cloth comprises wringer rollers disposed to wring cleaning agent from an endless cleaning cloth upon the endless cleaning cloth being immersed in a washing agent.

15. The apparatus for cleaning a cylinder surface of claim 14, wherein at least one of said first wash tank and said second wash tank comprises structure to permit connection to a device to clean washing agent disposed in said at least one of said first wash tank and said second wash tank.

16. An apparatus for cleaning a cylinder surface in a printing press, said apparatus comprising:

an application element to dispose an endless cleaning cloth in contact with a cylinder surface;

a device to wash a dirty endless cleaning cloth;

an arrangement to direct an endless cleaning cloth through said device to wash a dirty endless cleaning cloth;

a cleaning cloth drive mechanism, said cleaning cloth drive mechanism comprising an arrangement configured and disposed to move an endless cleaning cloth across said application element and through said arrangement to direct an endless cleaning cloth through said washing device;

said device to wash a dirty endless cleaning cloth comprising a first wash tank to immerse a dirty endless cleaning cloth in a first washing agent; and said device to wash a dirty endless cleaning cloth comprising a second wash tank to immerse a dirty endless cleaning cloth in a second washing agent, said second washing agent being different from said first washing agent.

17. The apparatus for cleaning a cylinder surface of claim 16, wherein said first washing agent is an ink solvent.

18. The apparatus for cleaning a cylinder surface of claim 16, wherein said first washing agent is water.

* * * * *